United States Patent [19]

Furjanić

[11] 4,433,330

[45] Feb. 21, 1984

[54] APPARATUS FOR DISPLAYING CHARACTERS ON A PICTURE SCREEN OF A DISPLAY UNIT

[75] Inventor: Ivan Furjanić, Munich, Fed. Rep. of Germany

[73] Assignee: Siemens Aktiengesellschaft, Berlin & Munich, Fed. Rep. of Germany

[21] Appl. No.: 247,077

[22] Filed: Mar. 24, 1981

[30] Foreign Application Priority Data

Apr. 10, 1980 [DE] Fed. Rep. of Germany ..... 3013706
Apr. 15, 1980 [DE] Fed. Rep. of Germany ..... 3014437

[51] Int. Cl.[3] ..... G09G 1/00

[52] U.S. Cl. ..... 340/750; 340/744; 340/801

[58] Field of Search ..... 340/750, 748, 744, 798, 340/799, 800, 801

[56] References Cited

U.S. PATENT DOCUMENTS 3,396,377 8/1968 Strout ..... 340/750
3,413,610 11/1968 Botjer et al. ..... 340/750
3,453,601 7/1969 Bogert ..... 340/750
3,675,208 7/1972 Bard ..... 340/750
4,240,073 12/1980 Seats ..... 340/703

*Primary Examiner*—Marshall M. Curtis
*Attorney, Agent, or Firm*—Hill, Van Santen, Steadman & Simpson

[57] ABSTRACT

An apparatus for displaying characters on a picture screen of a display unit has an image point memory interconnected between an image generator and a display unit. The image generator controls the display of the characters on a picture screen of the display unit and contains a character generator in which data words corresponding to the shape of the characters to be displayed are stored. The image point memory serves as an image repetition memory and contains an allocated memory having memory elements corresponding to all of the possible raster points on the picture screen. The contents of the allocated memory are cyclically read out and transmitted as a video signal to the display unit wherein the characters are displayed line by line. A logic element is preconnected to the allocated memory for permitting a number of characters to be superimposed for generating multiple characters and further permitting certain characters to be cancelled.

11 Claims, 3 Drawing Figures

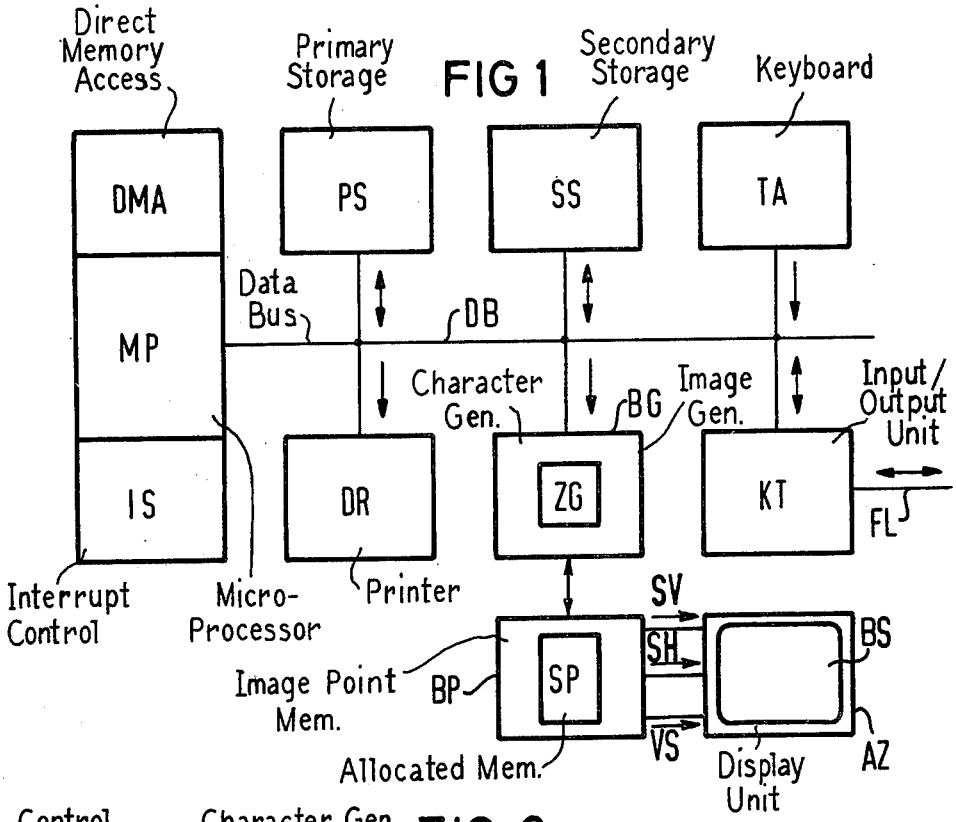
FIG 1
Direct Memory Access
Primary Storage
Secondary Storage
Keyboard
DMA
PS
SS
TA
MP
Data Bus
DB
Character Gen.
BG
Image Gen.
Input/Output Unit
IS
DR
ZG
KT
FL
Interrupt Control
Micro-Processor
Printer
SV
SH
BS
Image Point Mem.
BP
SP
VS
AZ
Allocated Mem.
Display Unit

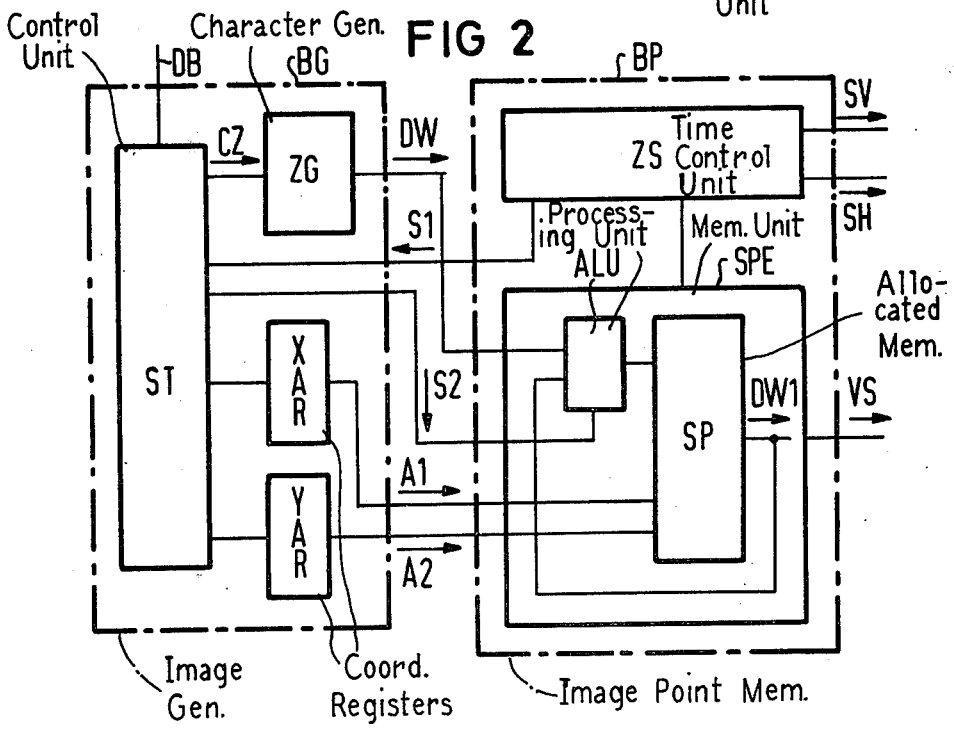
FIG 2
Control Unit
Character Gen.
DB
BG
BP
SV
CZ
ZG
DW
Time Control Unit
ZS
S1
Processing Unit
Mem. Unit
SH
ALU
SPE
Allocated Mem.
ST
XAR
S2
DW1
VS
SP
A1
YAR
A2
Image Gen.
Coord. Registers
Image Point Mem.

APPARATUS FOR DISPLAYING CHARACTERS ON A PICTURE SCREEN OF A DISPLAY UNIT

BACKGROUND OF THE INVENTION

1. Field of the Invention

The present invention relates to devices for displaying characters on a picture screen of a display unit in a line by line manner and in particular to such a device in which an image repetition memory is periodically read out and which employs an image generator containing a character generator for generating data words corresponding to the shapes of the characters.

2. Description of the Prior Art

An apparatus for displaying characters on a picture screen of a display unit is disclosed in German Pat. No. 2,540,734 in which characters to be displayed are encoded and stored as code characters in a data memory. An image control unit removes the code characters from the data memory in a periodic sequence corresponding to 50 or 60 image changes per second. The image control unit contains a character generator in which data words corresponding to the shapes of the characters which can be displayed on the picture screen are stored. The corresponding data words are read out from the character generator as a function of the characters to be displayed on the picture screen and are transmitted to the display unit as line signals. If the display unit is a cathode ray tube, the line signals represent video signals with which a trace unblanking of the electron beam is undertaken.

A further apparatus for displaying characters is known from German Pat. No. 24 46 048 in which the image repetition memory is designed as a shift register. The code characters corresponding to the characters to be displayed constantly circulate in the shift register in accord with the picture frequency. By the use of a multiplexer the code characters respectively representing one line are read out from the shift register. The code characters are supplied to a character generator which emits data words corresponding to the shapes of the characters. In this known arrangement, as in the apparatus described above, video signals for a display unit which is a cathode ray tube are generated by means of the data words.

In conventional devices such as those described above, a line scanning pattern which is formed from a plurality of lines and which cannot be altered is necessary for the representation of the characters. Moreover, the characters can only be displayed at prescribed character locations. While suitable for many applications, known devices result in a relatively inflexible display pattern.

SUMMARY OF THE INVENTION

It is an object of the present invention to provide an apparatus for displaying characters on a picture screen of a display unit which permits the characters to be displayed in any desired line scanning pattern and at any desired location on the picture screen.

The above object is inventively achieved in an apparatus having an image repetition memory which is interconnected between the image generator and the display unit and in which the image repetition memory is designed as a picture point memory provided with an allocated memory having memory locations allocated to each raster point on the picture screen. Data words can thus be stored in the allocated memory at random addresses.

An apparatus as described above constructed in accordance with the principles of the present invention has the advantage that the characters can be displayed at any desired location on the picture screen independently of a line scanning pattern. The image generator reads the code characters corresponding to the characters to be displayed as well as their respective coordinates on the picture screen from a working memory contained in a central control unit. The data words allocated to the code characters are generated by the use of the character generator and are stored in the image point memory such that the coordinates correspond to the respective addresses. In an embodiment wherein the working memory is a component of a microcomputer system and is connected to the image generator via a data bus, the apparatus has the further advantage that the data bus is subjected to significantly lower loads than if the working memory were to simultaneously serve as the image repetition memory, as in conventional devices. The inventive apparatus has the further advantage that graphic elements can also be displayed in a simple manner at any desired located on the picture screen.

For the display of double characters such as, for example, the character "$\phi$", representing the letter phi, by means of superimposing or striking over a number of characters stored in the character generator, as well as for changing or cancelling data words in the allocated memory in a simple manner, an embodiment of the invention has a logic element preconnected to the memory in the image point memory. The logic element permits data words to be connected or combined with other data words previously read out of the corresponding memory elements of the allocated memory before being stored in the allocated memory. To this end, the allocated memory is preferably operated in an operating mode known to those skilled in the art as "read-modify-write." With such an operating mode, the stored information is first read out at each memory cycle and may be changed, if desired, before renewed inscription of the information. The change is undertaken by means of the aforementioned logic element.

The inventive apparatus requires a particularly low circuit outlay if the logic unit is designed as an arithmetic and logic control unit and executes various linkages as a function of supplied control signals. Such arithmetic and logical control units can be commercially obtained as integrated circuits.

Although the allocated memory in the image point memory may be designed as a shift register, however, for the purposes of the present invention the inscription and readout of the data words can be undertaken with a memory which is designed as a semiconductor memory with random access, the latter arrangement requiring a significantly lower circuit outlay than a shift register, particularly if the memory is designed as a dynamic metal-oxide-semiconductor (MOS) memory with random access. By the use of such dynamic MOS memories, the stored information must be renewed at the latest after a respectively prescribed duration. In the inventive arrangement, no special measures are required for renewing the memory contents when such renewal of the data words stored in the memory is undertaken in accordance with the periodic readout of the characters to be displayed on the picture screen. An interruption of the display when data words are inscribed in the memory is thus not necessary when the inscription of the data words into the image point memory is undertaken during the line retrace and/or during the frame retrace.

If the data words are stored as bytes in the image point memory, it is preferable that the image point memory contain a parallel-to-serial converter whose parallel inputs are connected to the outputs of the memory and whose output is connected to the display unit.

For controlling the cooperative functions of the image point memory and the image generator and the display unit, it is preferable that the image point memory contain a time control unit for generating control signals for inscribing the data words in the memory for periodically reading out the data words from the memory, and for synchronization of the display unit.

DESCRIPTION OF THE DRAWINGS

FIG. 1 is a schematic block diagram of a telecommunication device including an apparatus for displaying characters on a picture screen of a display unit constructed in accordance with the principles of the present invention.

FIG. 2 is a detailed schematic block diagram of the image point memory and the image generator shown in FIG. 1.

DESCRIPTION OF THE PREFERRED EMBODIMENTS

Figure 3:
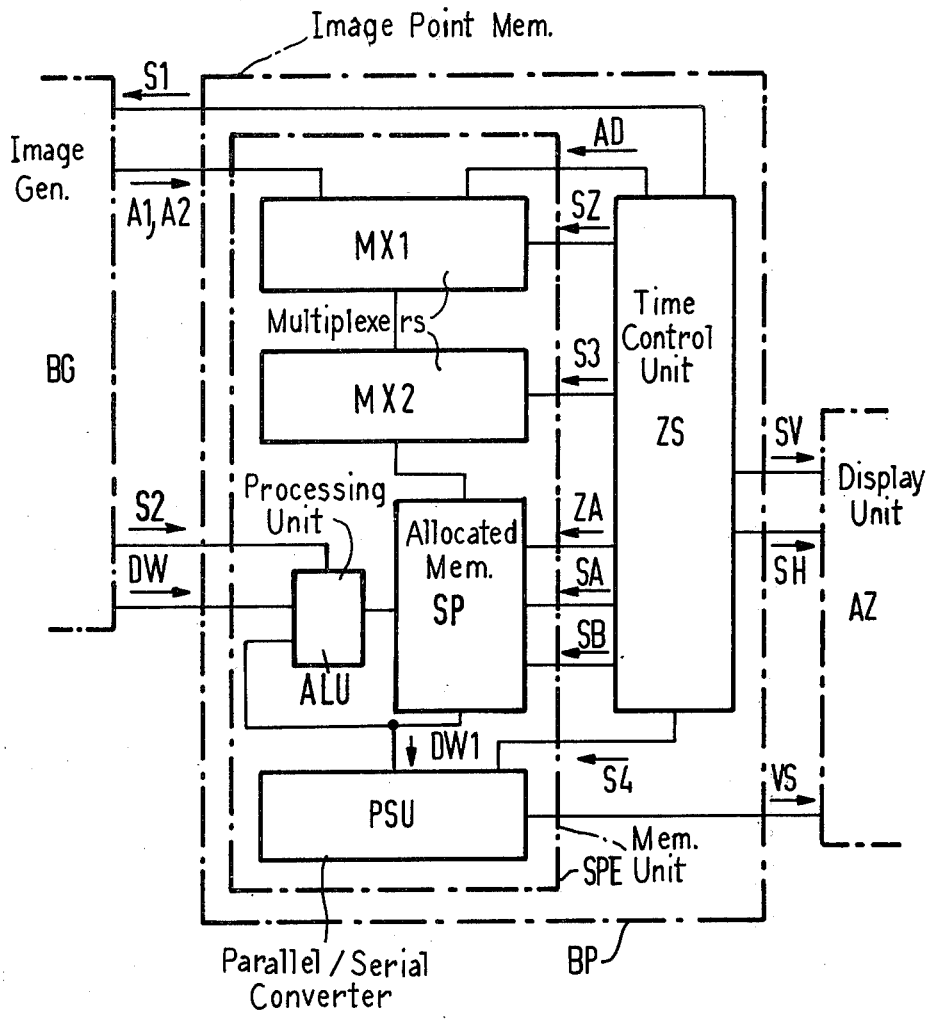
FIG. 3 is a detailed schematic block diagram of the memory unit within the image point memory shown in FIGS. 1 and 2.

A telecommunication device is shown in FIG. 1 which is controlled in a known manner by means of a microprocessor MP. An interrupt control IS and a programmable control unit for direct memory access DMA are connected to the microprocessor MP in a manner known to those skilled in the art. The system further includes a primary storage PS, a secondary storage SS, a keyboard TA, a printer DR, an input/output unit KT and a display unit AZ, having a picture screen BS, all of which are connected via a data bus DB and, if necessary, an address bus. The primary storage PS is a semiconductor memory and serves as a program memory and working memory. The secondary storage SS may be a floppy disc storage and/or a magnetic bubble memory. The keyboard TA contains conventional keys for the input of alphanumeric characters as well as function keys for the execution of various operations.

The printer DR is a conventional unit including a type printing unit or a mosaic printing unit. The input/output unit KT is also a conventional element which is connected to a long distance line FL for receiving and transmitting characters input by means of the keyboard TA or which may be stored characters.

The apparatus for displaying characters on the picture screen BS of the display unit AZ includes an image generator BG and an image point memory BP in addition to the display unit AZ. For representing characters on the picture screen BS, code characters allocated to the characters to be displayed are transmitted from the primary storage PS, or from the secondary storage SS, to the image generator BG via the data bus DB. The image generator BG contains a character generator ZG which has data words corresponding to the shape of the characters as is known in the art.

The corresponding data words are read out from the character generator ZG as a function of the code characters and are transmitted to the image point memory BP. An allocated memory within the image point memory BP is allocated to each raster or picture point on the picture screen BS. The data words are stored in the allocated memory SP. The image point memory BP serves as an image repetition memory and the data words are read out from the image point memory BP in accord with a picture frequency of approximately 50 or 60 image changes per second and are transmitted to the display unit AZ. The picture screen BS of the display unit AZ may be, for example, the screen of a cathode ray tube. In this case, a video signal is generated from the data words and the electron beam is trace unblanked by the video signal. The picture screen BS may also be formed of individual image elements, in which case the data words are supplied to the image elements.

The display of characters on the picture screen BS is undertaken line by line and the characters to be displayed are composed of picture or raster points which are arranged on the lines. A character location is formed, for example, from $6\times12$ picture points and the characters are displayed within the character location in a basic grid of $5\times7$ picture points.

The storage capacity of the allocated memory SP provided in the image point memory BP amounts to $512\times256$ bits, so that the characters can be displayed on the picture screen BS in 21 lines each comprising 85 characters.

Further details of some elements of the system shown in FIG. 1 are illustrated in FIGS. 2 and 3.

The image generator BG shown in detail in FIG. 2 contains a control unit ST which, for example, may be a microprocessor system. The control unit ST is connected at its input side to the data bus DB. For the display of a character on the picture screen BS, a code character CZ, allocated to the character to be displayed, is transmitted via the data bus DB to the image generator BG. The control unit ST transmits the code character CZ to the character generator ZG in which data words DW, allocated to the shape of the character, are stored. The character is formed in terms of screen lines, with each screen line corresponding to one data word DW. Address signals which are allocated to the coordinates of the character on the picture screen BS are transmitted via the data bus DB. These coordinates are intermediately stored in two registers XAR and YAR.

The image point memory BP contains a time control unit ZS which controls the transfer of the data words DW into the allocated memory SP provided within a memory unit SPE and also controls a readout of the data word DW from the allocated memory SP for generating the video signal VS as well as for generating signals SV and SH for respective vertical and horizontal synchronization of the display unit AZ.

The transfer of the data words into the memory unit SPE can be undertaken line by line or character by character. In the first case, the data words DW of the characters displayed on one line are respectively transmitted. In a second case, the data words DW allocated to a character are transmitted in chronological succession. The transmission preferably ensues after the display of a line or of a complete picture on the screen BS. This is determined by means of a signal S1 emitted by the time control unit ZS.

In order to manipulate the data words stored in the memory SP, a processing unit ALU is connected to the allocated memory SP. This processing unit ALU may be designed, for example, as a commercially available arithmetic and logical control unit. The unit ALU links the signals appearing at its inputs according to known arithmetic or logical functions. The type of linkage employed in a particular situation is prescribed by means of control signals S2 which are emitted by the control unit ST.

If information is stored in the allocated memory SP as bytes, the data words DW1 in the memory unit SPE are supplied to a parallel-to-serial converter which, after a parallel-to-serial conversion of the data words DW1, generates the video signal VS and transfers the video signal to the display unit AZ.

In the image point memory BP shown in FIG. 3, the memory unit SPE contains a dynamic MOS memory with random access which is the allocated memory SP. In order to display 512×256 raster points on the display unit AZ, the memory SP has a capacity of 16 KB. The memory SP is organized byte-wise so that its address space encompasses 16 K. The least significant address bits are represented by the address signals A2. The address signals A1 and A2 are supplied to a first multiplexer MX1. For inscribing the data words DW in the memory SP, the first multiplexer MX1 connects the address signals A1 and A2 to a second multiplexer MX2. The connection is undertaken by means of a signal SZ emitted by the time control unit ZS during the line retrace and/or during the frame retrace of the electron beam. As a result of a signal S3, the second multiplexer MX2 first connects the least significant bits as line addresses and subsequently connects the more significant bits as column addresses of the memory SP. At the same time, the time control unit ZS sends signals ZA and SA to the memory SP, which signals respectively indicate that the pending address is a line or column address. Simultaneously, a write signal SB is generated. Subsequently, the data word generated by the image generator BG is inscribed in the memory SP at the location identified by the address signals A1 and A2.

The memory SP is read out line by line for displaying the characters on the picture screen BS. The time control unit ZS contains a counter which generates address signals AD which, in a cyclical sequence, call the memory elements of the lines of the memory SP in chronological succession and, within the lines, those of the individual columns. For the readout, the signal SZ connects the signals AD to the output of the multiplexer MX1. In a manner similar to that occurring during inscription, the time control unit ZS generates the signals S3, ZA and SA so that the memory SP is read out line by line. The stored data words are read out in parallel byte-wise and are supplied as signals DW1 to the parallel-to-serial converter PSU. Controlled by a signal S4 from the time control unit ZS, the parallel-to-serial converter PSU generates the video signal VS from the data words DW1, the video signal VS being employed for the trace unblanking of the electron beam in the cathode ray tube of the display unit AZ. At the same time, the time control unit ZS generates the synchronization signals SV and SH for the display unit AZ.

For representation of characters whose shapes are stored in the character generated ZG, the data words DW, controlled by the signal S2, are connected unaltered to the memory SP via the processing unit ALU.

For representing multiple characters which may be composed of a number of characters stored in the character generator ZG, the data words of a first character are first inscribed in the memory. After readout of the stored data words DW1, the data words are linked with the data words DW of a further character in the processing unit ALU in accord with an OR linkage and are inscribed at the corresponding location in the memory SP at which the data words DW1 were previously stored. A combination of the raster or picture point quantities of both characters is undertaken in such a manner that the combination quantity of the raster points is displayed on the screen BS. To this end, the memory SP is preferably operated in the operating mode "read-modify-write" by which the stored information is first read out and subsequently reinscribed at the same memory location, after a change or alteration if necessary. The OR linkage is set by the signal S2.

In order to cancel a data word stored in the memory SP, the data word to be cancelled, after being read out, is linked in accord with an exclusive OR function to the data word DW emitted by the character generator ZG. As a result of the linkage or combination of two identical data words, a data word formed only of binary 0 values is inscribed in the memory SP. The antivalence function is also set by means of the signal S2. It is similarly possible to display the characters inversely on the screen BS, so that the colors of the background or of the character are interchanged when the data words DW or DW1 are linked in accord with an antivalence function with a data word formed only of binary values 1.

The memory SP is interpreted as the image of the picture screen BS. A memory element in the memory SP is allocated to each possible raster point on the screen BS. When the electron beam is to be trace unblanked at the location allocated to a possible picture point, a binary character with a first binary value, for example, the binary value 1, is inscribed in the corresponding memory element. In an analogous manner, binary characters with the binary value 0 are inscribed at those locations at which the electron beam is not to be trace unblanked. Each line of the memory SP corresponds to a line on the picture screen BS. By the use of the memory SP, the characters can be displayed at any desired coordinates on the picture screen BS, with the coordinates being identified by the address signals A1 and A2.

Although modifications and changes may be suggested by those skilled in the art it is the intention of the inventor to embody within the patent warranted hereon all changes and modifications as reasonably and properly come within the scope of his contribution to the art.

I claim as my invention:

1. An apparatus for displaying characters on a picture screen of a display unit line by line comprising:

an image generator including a character generator for generating data words corresponding to the shapes of the characters to be displayed;

an image repetition memory interconnected between said image generator and said display unit and a means for periodically reading out the contents of said image repetition memory;

an allocated memory connected to said image repetition memory having one memory element allocated to each raster point on said picture screen, said data words being stored in said memory elements at random addresses for display on said picture screen in any desired pattern; and a processing unit having a logic linkage interconnected between said allocated memory and said image generator for combining data words read out of said memory elements in said allocated memory with data words from said image generator and for entering a combined data word formed therefrom by said processing unit in said allocated memory for storage therein.

2. The apparatus of claim 1 wherein said processing unit is an arithmetic and logic control unit for performing a plurality of arithmetic and logic linkages upon receipt of a suitable control signal from said image generator.

3. The apparatus of claim 1 wherein said allocated memory is a semiconductor memory with random access.

4. The apparatus of claim 3 wherein said memory is a dynamic metal-oxide-semiconductor memory with random access.

5. The apparatus of claim 4 wherein the renewal of data words stored in said allocated memory is undertaken by means of a periodic readout of the display of said characters on said picture screen.

6. The apparatus of claim 1 wherein inscription of said data words into said image repetition memory is undertaken during the line retrace of the picture screen.

7. The apparatus of claim 1 wherein the inscription of said data words into said image repetition memory is undertaken during the frame retrace of said picture screen.

8. The apparatus of claim 1 wherein said image repetition memory further includes a parallel-to-serial converter having parallel inputs connected to the outputs of said allocated memory and having an output connected to said display unit.

9. The apparatus of claim 1 wherein said image repetition memory further includes a time control unit for generating control signals for inscribing data words into said allocated memory and for said periodic readout of said data words from said allocated memory and for synchronizing the display unit.

10. The apparatus of claim 2 wherein said processing unit combines said data words read out of said memory elements in said allocated memory with said data words from said image generator according to the OR function.

11. The apparatus of claim 2 wherein said processing unit combines said data words read out of said memory elements in said allocated memory with said data words from said image generator according to the exclusive OR function.

* * * * *